United States Patent [19]

Pfeifer

[11] Patent Number: 4,932,540

[45] Date of Patent: Jun. 12, 1990

[54] MERCHANDISE DISPLAY FIXTURE

[75] Inventor: William Pfeifer, Springdale, Pa.

[73] Assignee: Armstrong Store Fixture Corporation, Pittsburgh, Pa.

[21] Appl. No.: 343,685

[22] Filed: Apr. 24, 1989

[51] Int. Cl.[5] ..... B01D 25/12

[52] U.S. Cl. ..... 211/204; 211/193; 248/219.1; 248/354.6

[58] Field of Search ..... 248/188.5, 222.2, 219.1, 248/345.5, 200.1, 408, 409, 354.6, 55; 211/490, 192, 193, 196, 195; 403/348, 349, 381, 109, 377

[56] References Cited

U.S. PATENT DOCUMENTS

| | | | |
|---|---|---|---|
| 744,149 | 11/1903 | Wilton | 211/193 X |
| 1,216,014 | 2/1917 | Thrune | 248/219.1 |
| 2,957,187 | 10/1960 | Raia | 248/188.5 |
| 3,023,912 | 3/1962 | Sebastian | 211/196 |
| 4,253,578 | 3/1981 | Rekow | 211/204 X |
| 4,588,157 | 5/1986 | Mills | 248/530 X |

FOREIGN PATENT DOCUMENTS

| | | | |
|---|---|---|---|
| 2235304 | 2/1974 | Fed. Rep. of Germany | 248/354.6 |
| 88433 | 12/1966 | France | 248/219.1 |

*Primary Examiner*—David L. Talbott
*Assistant Examiner*—Daniel Hulseberg
*Attorney, Agent, or Firm*—Parmelee, Miller, Welsh & Kratz

[57] ABSTRACT

A fixture for displaying merchandise has telescoping structural members. A vertically extending tubular member adjustably supports an elongated member having a generally horizontal arm for displaying the merchandise and a vertical arm telescopingly received in the vertical tubular member. The telescoping vertical arm has a peripheral surface and a distal end with circumferentially spaced protuberances about the peripheral surface near the distal end for maintaining a spaced relationship between the peripheral surface of the telescoping vertical arm and the vertical tubular member. A collar or hub mounted on the upper end of the vertical tubular member has circumferentially spaced fingers for maintaining the peripheral surface of the telescoping vertical arm and the upper end of the vertical tubular member in spaced relationship. The protuberances and the fingers coact to maintain a spaced relationship between the telescoping vertical arm and the vertical tubular member and thereby prevent scratching of the peripheral surface of the vertical sliding arm. The spacing of the protuberances is matched with the spacing of the fingers whereby the vertical arm may telescope past a mounted collar or hub. The telescoping vertical arm and the vertical tubular member are interlocked by a bullet catch. A display support arm may extend from a sleeve having a tab received in a bullet catch hole.

19 Claims, 5 Drawing Sheets

MERCHANDISE DISPLAY FIXTURE

This invention relates to merchandise display fixtures and, more particularly, to fixtures which have telescoping structural members for displaying merchandise at different levels.

Merchandise display fixtures generally are used in retail stores for displaying clothing and other articles on hangers supported by generally horizontally extending display means attached to the fixtures. As the displayed stock changes from season to season or from model to model or as the fixtures are employed to display other articles, the telescoping structural members ar readjusted in order to display the new merchandise at the desired level. Thus, for example, a fixture originally employed to display overcoats for adults may be later used to display infant ware. Also, these fixtures may be disassembled so that they may be transported from location to location It is necessary that the fixtures have an attractive appearance for presenting a sales favorable atmosphere. Thus the structural members are frequently polished stainless steel or are another metal which may have an attractive coating. The structural members may also be molded plastic or other suitably strong material. However in use, set-up or knock-down of these fixtures, the surfaces of telescoping members may become badly scratched when the surface one telescoping member slides against the surface of the other member or when display arms are attached to them.

Recently developed fixtures have generally remedied the scratching problem, but these fixtures generally have many parts which in many instances will be quickly and perhaps almost carelessly handled during set-up or knock-down of the fixtures by relatively unskilled workers. Thus, parts are not properly assembled or are mislaid and the fixtures are eventually scratched. See, e.g., U.S. Pat. No. 4,767,014 to Vail et al. which discloses painted telescoping members spaced by several plastic sleeves or U.S. Pat. No. 3,807,574 to Lanza which discloses the use of rollers.

SUMMARY OF THE INVENTION

The merchandise display fixture of the present invention is simple in design, can be quickly set up, adjusted or knocked down by unskilled persons without having to refer to instructions and, most importantly, without scratching telescoping members. In addition a knocked down fixture can be easily carried from one place to another. The fixture generally has a vertically extending tubular member for telescopingly receiving in its upper end the distal end of a vertical arm of an elongated member. The telescoping vertical arm has circumferentially spaced protrusions near its distal end for maintaining its peripheral surface near the protusions in spaced relationship with the inner surface of the vertical tubular member. The elongated member also has a generally horizontal arm for supporting the merchandise to be displayed. A locking means interlocks the telescoping vertical arm and the vertical tubular member. A spacer means mounted on the upper end of the vertical tubular member has circumferentially spaced fingers for maintaining a spaced relationship between the portion of the peripheral surface of the telescoping vertical arm near the spacer means and the upper end of the vertical tubular member. The circumferential spacing of the fingers is matched with the spacing of the protrusions on the distal end of the telescoping vertical arm.

In a preferred embodiment of the present invention, the fixture has a removeable display support means comprising a generally horizontal arm (or other means for supporting merchandise) extending outwardly from a sleeve juxtaposed with one of the vertical members. The sleeve has an upper generally U-shaped section defined by a central bail portion extending to generally parallel distal first and second ends with the central bail portion having an inwardly extending tab adapted to engage one of the holes in the vertical members. A vertical section of the sleeve extends from one of the ends of the upper U-shaped section down to one of two generally parallel ends extending from a central bail section which define a lower generally U-shaped section. The lower central bail is disposed on opposite sides of the vertical member from the upper U-shaped section. The means for supporting merchandise extends outwardly from the lower U-shaped section. Preferably at least one resilient member extends inwardly of the sleeve for engaging the vertical member to prevent scratching of the vertical member and for locking the sleeve with the vertical member.

DESCRIPTION OF THE DRAWINGS

Other details, objects and advantages of the invention will become apparent as the following description of certain preferred embodiments thereof shown in the accompanying drawings proceeds.

In the accompanying drawings.

DETAILED DESCRIPTION

Figure 1:
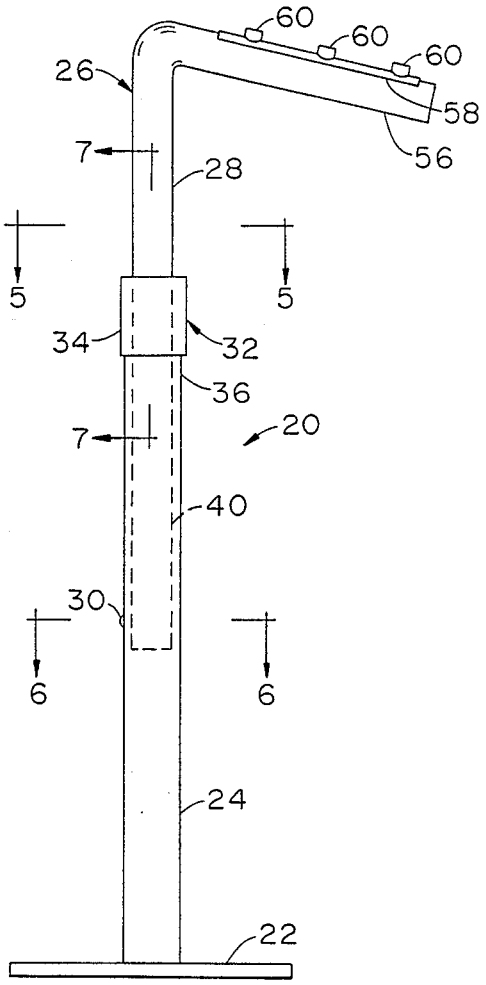
FIG. 1 is a front view of a fixture for displaying merchandise which embodies the present invention.

FIGS. 1 ad 2 generally illustrate a freestanding fixture 20 for displaying merchandise (not shown) to be sold in retail stores.

Figure 5:
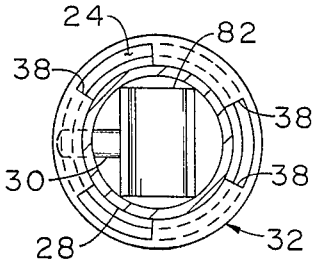
FIG. 5 is an enlarged plan sectional view of the fixture of FIG. 1 taken along line 5—5.
Figure 7:
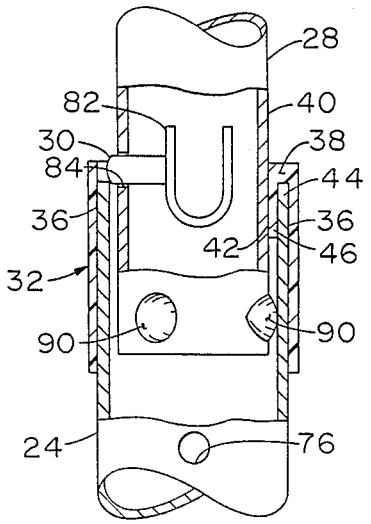
FIG. 7 is an enlarged fragmentary sectional view of the fixture of FIG. 1 taken at line 7—7 on FIG. 1, but showing the telescoping vertical arm rotated to align the bullet catch with the spacing of the fingers with the bottom of the vertical tubular member.

The fixture 20 has a base 22 supporting a vertical tubular member 24 and an elongated member 26 having a vertical arm 28 which is telescopingly supported by the vertical tubular member 24. A bullet catch 30, or other locking means, interlocks the telescoping vertical arm 28 of the elongated member 26 with the vertical tubular member 24. A spacer means, comprising a plastic tub or collar 32 having a side wall 34, is friction fit or otherwise suitably mounted on the upper end 36 of the vertical tubular member 24. As is best seen in FIGS. 5 and 7, the hub or collar 32 has inwardly directed radially spaced fingers 38 for maintaining the peripheral surface 40 of the telescoping vertical arm 28 and the vertical tubular member 24 in spaced relationship to prevent scratching of the peripheral surface 40. As is best shown in FIG. 7, the fingers 38 may be bent downwardly to form an axially extended surface 42 for guiding the vertical movement of the telescoping vertical arm 28. Spacing the downwardly bent fingers 38 also enables the fingers 38 to resiliently receive the upper end 36 of the vertical tubular member 24 in spaced resilient channels 44 and enables air in the channels 44 to simultaneously vent to the atmosphere. The distal ends 46 of the fingers 38 may also obliquely extend inwardly and thereby permit ready entry of the upper end 36 of the vertical tubular member 24 into enlarged channel entrances. The oblique distal finger ends 46 will be bent to a position generally parallel to the hub side wall 34 by the telescoping vertical arm 28.

The elongated member 26 (FIG. 4) has a substantially horizontal arm 56 extending from the vertical arm 28 for supporting the merchandise (not shown). As is shown, the arm 56 is within at least abut 60° of a horizontal position and may have a strip 58 with a plurality of vertically extending posts 60 for supporting hangers or packaging in spaced relation (not shown). Where scratching is not a problem or spacing is not a concern, the merchandise supporting arm may simply extend horizontally of the telescoping vertical arm 28. The horizontal arm 56 may have other known devices for protecting its surface from scratching by the merchandise or hangers.

Figure 3:
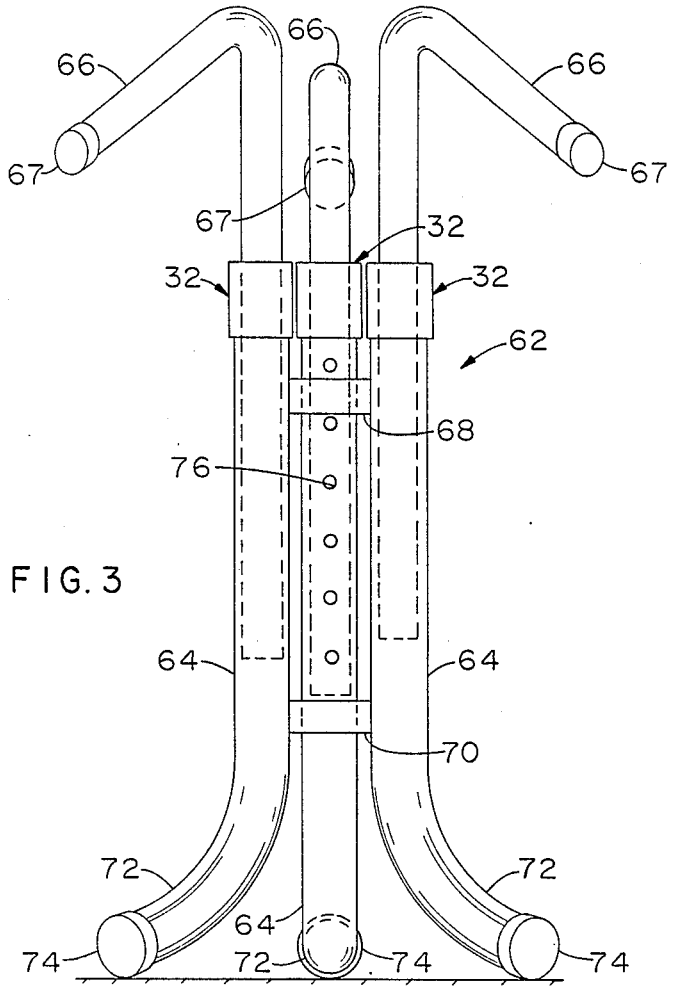
FIG. 3 is a front view of a second embodiment of the present invention generally comprising three attached fixtures of the type shown in FIGS. 1 and 2.

FIG. 3 shows a fixture 62 embodying the present invention which comprises a plurality of, illustrated as three, vertical tubular members 64 for releasably supporting up to three elongated members 66 at the same time, and at the same or different elevations. The elongated members 66 as shown are within about 30° of the horizontal position and have end caps 67. They may have strips with posts such as is illustrated in FIG. 1 if desired to protect the elongated members 66 from being scratched by hangers. The three vertical tubular members 64 are welded or otherwise suitably attached to a pair of brackets 68, 70 and have horizontally extending bent bottom ends 72, which may be covered with friction fitting end caps 74. The three bent ends 72 form an attractive base for supporting the fixture 62. In other embodiments of the invention, display fixtures may have more than three vertical tubular members although only three of the tubular members would need to have horizontally extending supporting ends. The vertical tubular members 64 and the elongate members 66 are otherwise similar to the tubular member 24 and the elongate member 26 of FIG. 1 and therefore the following description will generally describe the invention with reference to the embodiment of the invention shown in FIG. 1.

Figure 2:
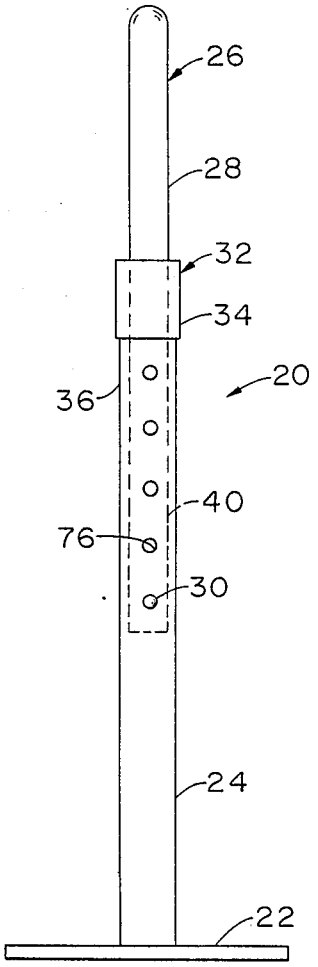
FIG. 2 is a side view of the fixture of FIG. 1 showing a bullet catch interlocking the vertical tubular member and the telescoping vertical arm.
Figure 4:
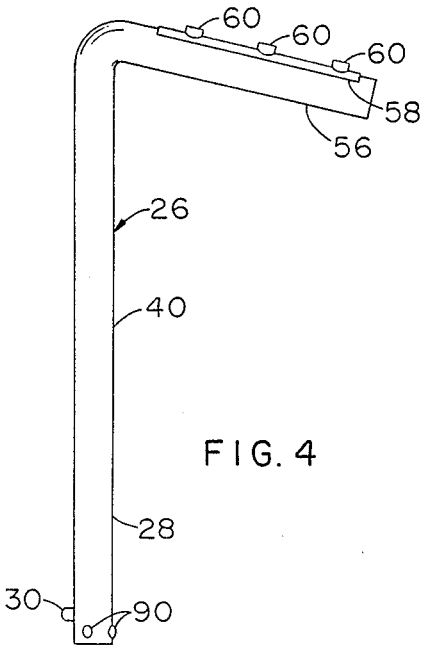
FIG. 4 is a front view of an elongated member for supporting merchandise for use with the fixtures of FIGS. 1–3.

As is most clearly seen in FIG. 2 the vertical tubular member 24 has vertically spaced holes 76 for receiving the bullet catch 30 for interlocking the elongated members 26 within the vertical tubular member 24. Thus in the fixture 62 shown in FIG. 3, on a elongated member 66 may be locked in a vertical tubular member 64 at a relatively low elevation for supporting shirts whereas another elongated member 66 may be locked in another vertical tubular member 64 at a relatively high level for supporting long coats. As is best shown in FIGS. 1 and 4, the bullet catch 30 and the horizontal arm 56 are oriented at about 180° to each other. This orientation easily located a hidden bullet catch 30 in a vertical tubular member 24 during the set-up process and then the weight of the arm 56 urges the bullet catch 30 into interlocking engagement in a hole 76 when the fixture 20 is in use.

Figure 6:
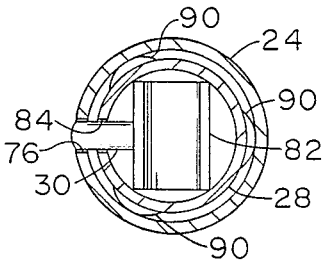
FIG. 6 is an enlarged plan sectional view of the fixture of FIG. 1 taken along line 6—6.

The bullet catch 30 may be disposed in the lower end of the telescoping vertical arm 28 as is shown in FIGS. 4 and 7. The bullet catch 30 is fastened to a U-shaped flat spring 82 which urges the bullet catch 30 outwardly through a hole 84 in the vertical arm 28 until an edge of the spring 82 adjacent the bullet catch 30 is stopped by the wall of the vertical arm 28. Other known spring devices and stops may be alternatively used in place of the flat spring 82. FIG. 6 shows the bullet catch 30 in a vertically spaced hole 76 in the vertical tubular member 24 when the telescoping vertical arm 28 is locked in position. The telescoping vertical arm 28 may be unlocked by simply pressing inwardly on the bullet catch 30 and sliding the bullet catch 30 to another position. A fixture having several elongated members such as the fixture 62 of the FIG. 3 preferably has vertically spaced holes 30 facing the interior portion of the fixture so that the bullet catch 30 can not be casually pressed. FIG. 7 shows the relative positions of the vertical tubular member 24 and the telescoping vertical arm 28 when the telescoping vertical arm 28 is inserted or removed in the upper end 36 of the tubular member 24. As is shown, the circumferential spacing between the fingers 38 of the hub 32 mounted on the upper end 36 of the vertical tubular member 24 permits the bullet catch 30 to move past the hub 32.

As FIGS. 4 and 7 best show, the telescoping vertical arm 28 has three or more circumferentially spaced protuberances such as nubs 90 disposed about its peripheral surface 40 near its distal end. The nubs 90 maintain the distal end of the telescoping vertical arm 28 in spaced relationship with the vertical tubular member 24 and coact with the spacer means to protect the peripheral surface 40 of the telescoping vertical arm 28 from being scratched by the vertical tubular member 24. The circumferential spacing of the nubs 90 is matched with the circumferential spacing of the fingers 38 of the hub 32 so that the distal end of the vertical arm 28 can move past the vertical tubular member 24. As is shown in FIGS. 5,6 and 7, the bullet catch 30 may be circumferentially aligned with the spacing between adjacent two nubs 90. Such an orientation prevents an accidental disassembly of the fixture 20 by mere telescoping movement without partially rotating the vertical arm 28 after the bullet catch 30 has passed the fingers 38. This helps to prevent accidental separation of the elongate member 26 from the vertical tubular member 24. Similarly, during set-up of the fixture 20, the vertical arm 28 can be telescoped into the vertical tubular member 24 only to a desired depth which is determined by the axial distance of the bullet catch 30 above the distal end of the vertical arm 28. The bullet catch 30 will engage a finger 38 if the vertical arm 28 is not at least partially rotated or the bullet 30 is depressed. In addition, the surfaces 42 of downwardly bent fingers 38 and the areas of the contact provided by the nubs 90 provide sufficient circumferential support for the elongated member 26 to be vertically maintained in place by the bullet catch 30 engaged with the upper end 36 of the vertical tubular arm 24. Thus the telescoping vertical arm 28 may be aligned and inserted in the vertical tubular member 24 and then vertically located.

Instead of nubs 90 which are punched the vertical arm 28 as shown are otherwise attached to the vertical arm 28, the protuberances may alternatively extend outwardly from an insert such as a friction fitting end cap (not shown) which may be slipped on the distal end of the vertical arm 28 in the same manner that the spacer means fits over the vertical tubular member. In another embodiment (not shown) the protrusions are outwardly bent tabs which are defined by pairs of closely spaced lengthwise cuts in the distal end of the telescoping vertical arm 28. See, e.g., FIG. 17 which shows a similar tab (but inwardly directed) tab 184 cut in the lower end of a tubular shaped sleeve 174.

The fixture 20 of the present invention is particularly convenient to assemble where there are only one or two (and preferably one) spacer means employed to space each telescoping vertical arm 28 and the vertical tubular member 24 before the vertical arm 28 is inserted in the vertical tubular member 24. Thus the peripheral surface of the telescoping vertical arm 28 and peripheral surface of the upper portion of the vertical tubular member 24 cannot be accidentally scratched during set-up, knock-down or use of the fixture 20 because the telescoping action. Also, there are only two relatively large separate pieces, including the elongate member with telescoping vertical arm 28 and the vertical tubular member 24 with its mounted collar or hub 32, to handle, transport or keep in storage.

Figure 9:
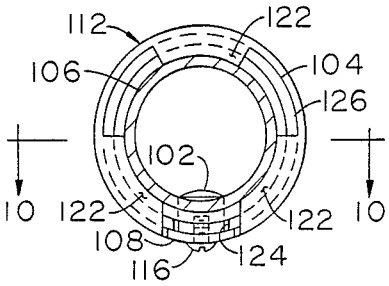
FIG. 9 is a sectional view of the fixture shown in FIG. 8 taken along section line 9—9.
Figure 8:
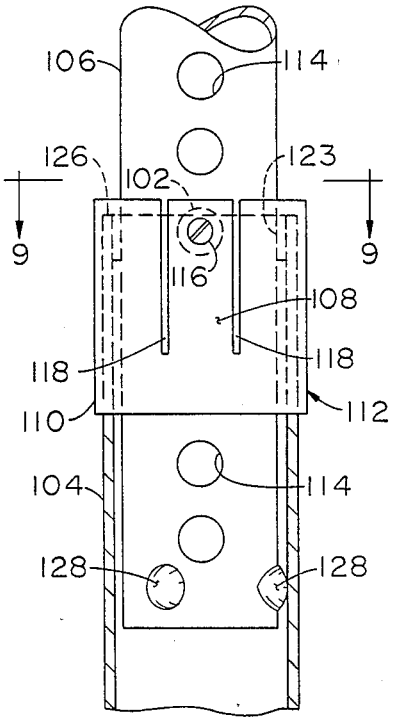
FIG. 8 is a fragmentary elevation view of the upper end of a vertical tubular member showing an alternative embodiment of the invention wherein the telescoping vertical arm has vertically spaced holes for receiving a bullet catch attached to the spacer means.
Figure 10:
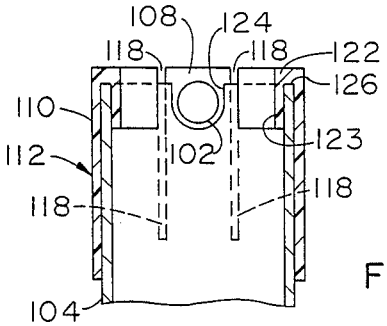
FIG. 10 is a fragmentary sectional elevation view of the upper end of the vertical tubular member shown in FIGS. 8 and 9, taken along line 10—10.

FIGS. 8–10 show an embodiment of the present invention wherein a bullet catch 102 for interlocking a vertical tubular member 104 and a telescoping vertical arm 106 is attached to a resilient section 108 of a sidewall 110 of a hub 112 for engaging one of a plurality of vertically spaced holes 114 in a telescoping vertical arm 106. The bullet catch 102 may be fixedly attached by a screw 116, pin or other suitable means to the resilient section 108 of the hub 112, or integrally formed therewith, which resilient section 108 may be formed by closely spaced axially directed cuts 118 extending from the top edge of the hub 112 to below the fingers 122 and preferably the bullet catch 102 is disposed in the circumferential space between two fingers 122. The bullet catch 102 extends through a slot 124 or hole adjacent the upper edge 126 of the vertical tubular member 104 with the bullet catch 102 normally extending into the region in which the vertical arm 106 telescopes. One advantage of this structure is that the bullet catch 102 of the spacing means keys into the vertical tubular member 104 so that there is only one way of assembling the fixture.

The telescoping vertical arm 106 may be aligned with the hub 112 and inserted to a depth where either the bottom of the vertical arm 106 or the bottom of the nubs 128 engages the bullet catch 102. The resilient section 108 of the spacer means may be pulled outwardly of the vertical tubular member 104 until the bullet disengages from the telescoping arm 106 and the arm 106 may then be telescoped into the vertical tubular member 104 to depth where the nubs 128 are below the fingers 122. Preferably the vertically spaced holes 114 are not in line with the nubs 128 so that the telescoping vertical arm 106 must be partially rotated to align the vertically spaced holes 114 with the bullet catch 102 for interlocking coaction. Such an orientation causes the nubs 128 to be axially aligned with the fingers 122 of hub 112 so that the vertical arm 104 cannot be inadvertently separated from the vertical tubular member 106 by mere telescoping action. The vertical arm 106 is then telescoped to the desired elevation and bullet catch 102 is then resiliently urged into the appropriate vertically spaced hole 114 by the resilient section 108 of the hub 112.

Preferably the vertically spaced bullet-receiving holes 114 are oriented at 180° to the horizontal arm of the elongate member for urging the telescoping vertical arm 106 into interlocking engagement with the bullet catch 102. Also, the bullet catch 102 is preferably disposed at about 180° to a finger 122 so the telescoping vertical arm 106 tends to pivot on a spaced resilient finger as the weight of the merchandise exerts forces on the upper end of the telescoping vertical arm 106 and thereby urges the lower end into interlocking engagement. Most preferredly the bullet catch 102 is in the axial plane of the circumferential surface 123 presented by spaced downwardly bent fingers.

Figure 11:
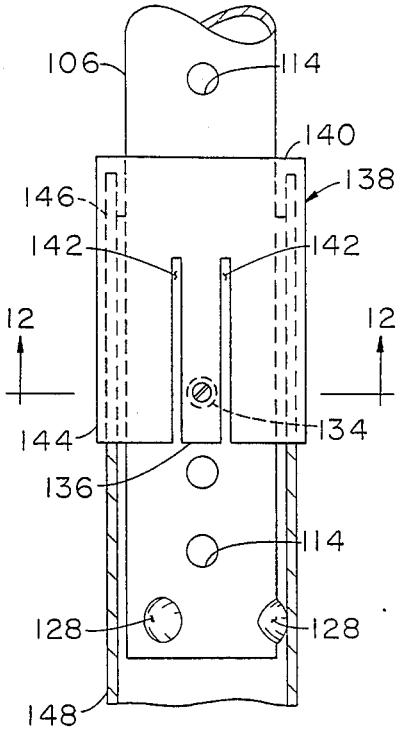
FIG. 11 is a fragmentary elevation view showing an alternative embodiment of the present invention wherein the telescoping vertical arm has holes for receiving a bullet catch attached to the spacer means below the fingers.
Figure 12:
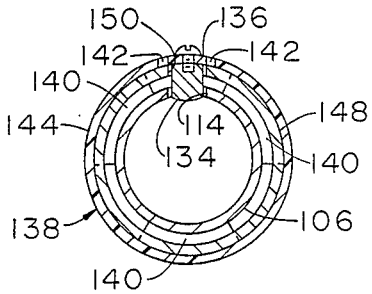
FIG. 12 is a sectional bottom view of the fixture shown in FIG. 11 taken along section line 12—12.

FIGS. 11 and 12 show an embodiment of the present invention similar to the embodiment of FIGS. 8–10 where a bullet catch 134 is attached to a resilient section 136 of the hub 138 at a location axially below the fingers 140. The resilient section 136 of the hub 138 is defined by two closely spaced axial cuts 142 extending from its lower end. The sidewall 144 of this hub 138 is also somewhat resilient and may be very easily fit cover the upper end 146 of the vertical tubular member 148. The bullet catch 134 shown in FIGS. 11–12 extends through a hole 150 in a vertical tubular member 148 and normally extends into the space where the vertical arm 106 telescopes. The resilient section 136 of the hub 138 may be urged outwardly to permit telescoping action of the vertical arm 106. When the vertical arm 106 is at the desired location, the appropriate vertically spaced hole 114 of the telescoping vertical arm 106 is aligned with the bullet catch 134 of the hub 138 and the resilient section 136 then urges the bullet catch 134 into interlocking engagement with the vertical arm 106. An advantage of the embodiment of the invention of FIGS. 11 and 12 is that the bullet catch 134 can be axially located well below the fingers 140 so that the telescoping vertical arm 106 can be deeply inserted into the vertical member 148 before engaging the bullet catch 134 for supporting the telescoping arm 106. The slightly resilient sidewall 144 permits the hub 138 to be easily removed from vertical tubular member 148 of the bullet 134 should be broken by, e.g., the weight of the merchandise.

Figure 13:
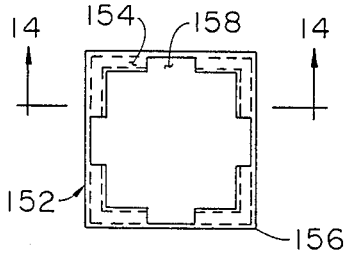
FIG. 13 is a top view of a rectangular spacer means for fitting on a rectangular tubular member.
Figure 14:
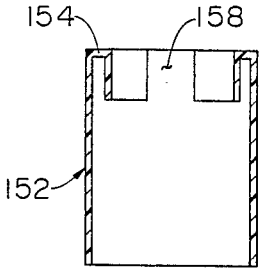
FIG. 14 is a sectional elevation view of the rectangular spacer means of FIG. 13 taken along section, line 14—14.

FIGS. 13 and 14 show a rectangular hub 152 which would be used with rectangular shaped vertical tubular members and telescoping vertical arms rather than the cylindrical shaped vertical tubular members shown in FIGS. 1–12. The fingers 154 are located at the corners 156 of the hub 152 with intermediate spacing 158 enabling the nubs on the vertical arms to telescope past the hub 152. Any of the above discussed bullet catch mechanisms may be used with rectangular telescoping members.

Figure 15:
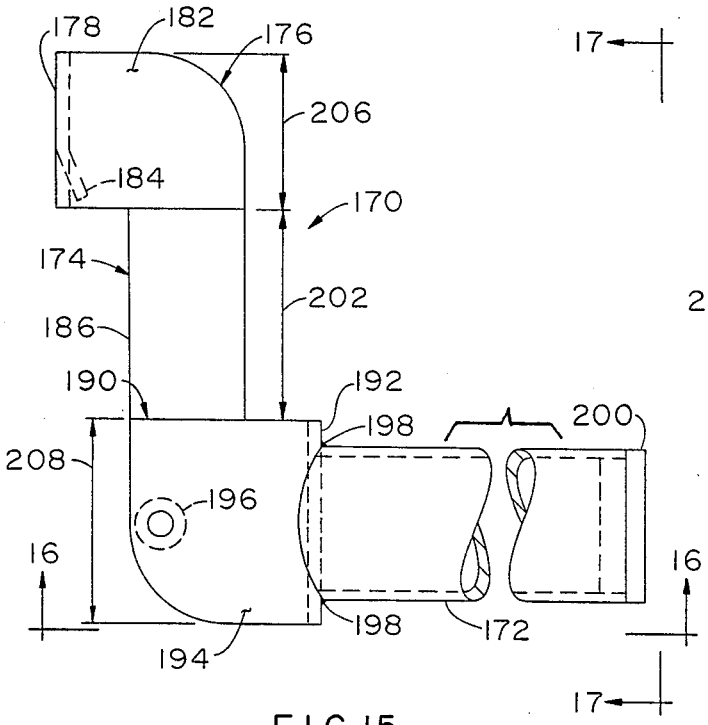
FIG. 15 is a side view of a releasably attachable display support member.

FIG. 15 shows a display support means such as a display member 170 which releasably engages the vertically spaced bullet-receiving holes 76 of the vertical tubular member 24 for supporting merchandise at lower levels than can be provided by the elongated member 26. The display member 170 could however be employed with the elongate members in those embodiments of the present invention shown in FIGS. 8–12 where the bullet catch engages vertically spaced holes 114 in the telescoping vertical arm 106.

Figure 17:
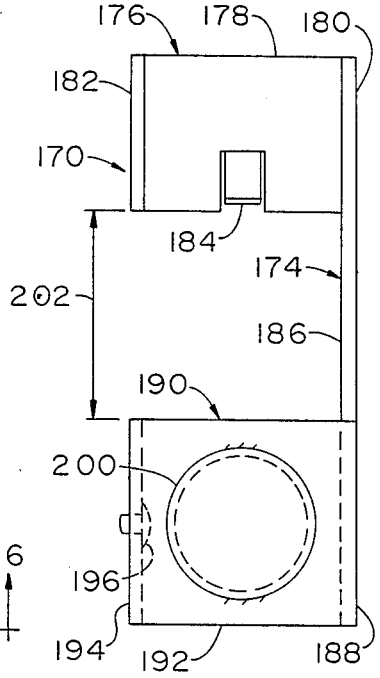
FIG. 17 is an end view of the support shown in FIG. 15.
Figure 16:
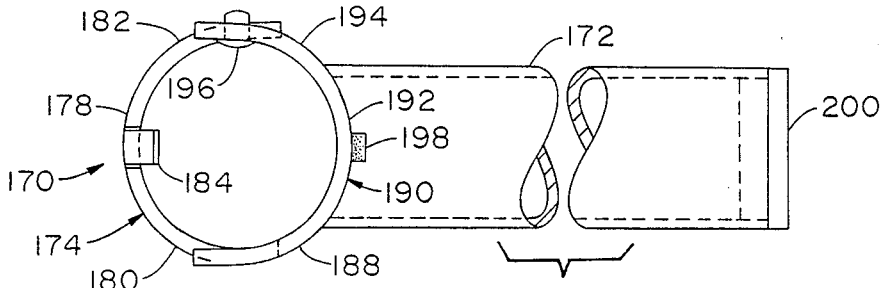
FIG. 16 is a plan view of the support shown in FIG. 15.
Figure 18:
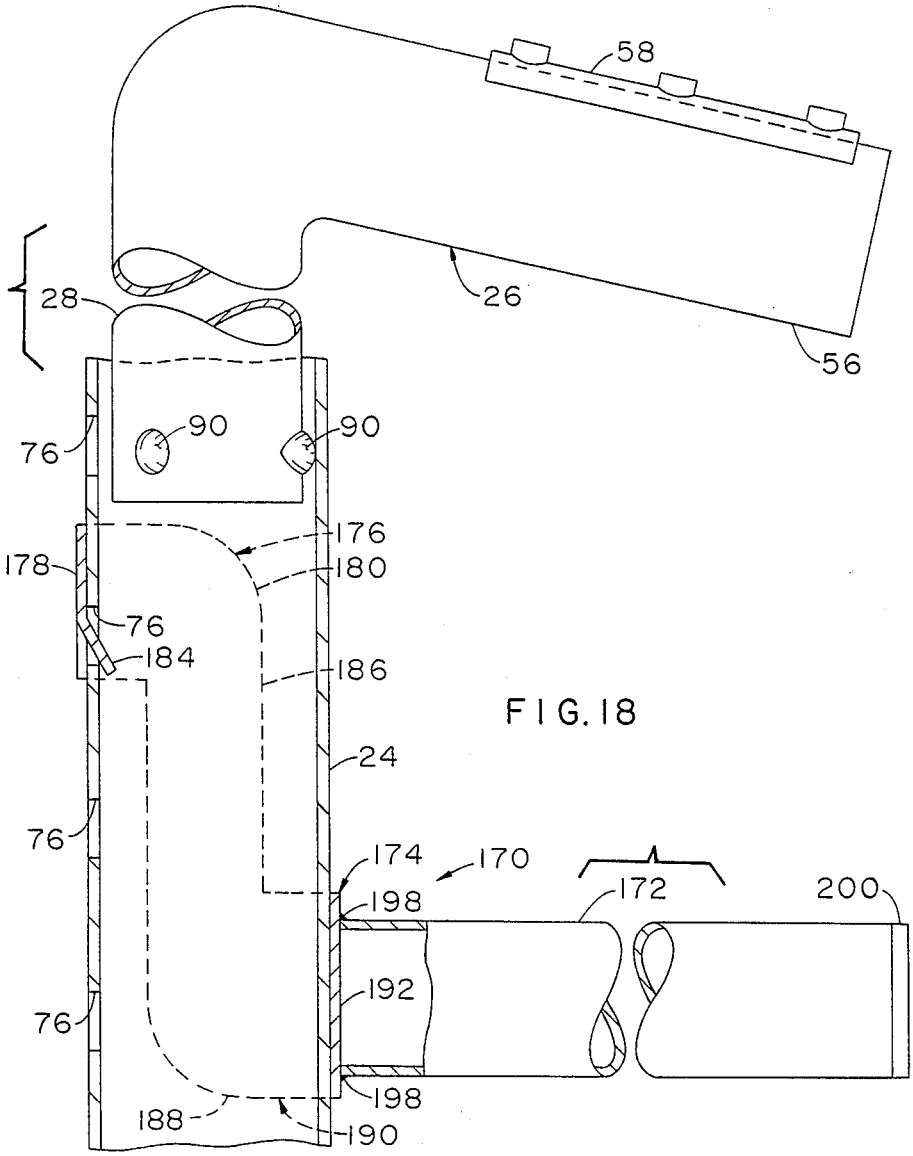
FIG. 18 is a sectional elevation view of the support shown in FIG. 16 and attached to a fixture.

The display member 170 generally has a horizontal arm 172 for supporting merchandise on a hanger. The horizontal arm 172 may be protected by any suitable means such as the strip 58 shown in FIG. 1 (not shown in FIG. 15). The horizontal arm 172 extends from a sleeve 174 juxtaposed with the vertical tubular member 24. The sleeve 174 has an upper generally U-shaped section 176 defined by a central bail portion 178 extending to generally parallel distal ends 180,182. A tab 184 extends inwardly from the central bail portion 178 of the upper U-shaped section 176 to engage a vertical spaced hole 76 as shown in FIG. 18. Preferably, the tab 184 extends well into the space where the vertical arm telescopes so that the tab 184 will act as a safety stop in the event a bullet catch 30 (not shown) slips past the holes 76. Also, the bullet catch 30 will also be protected against an axially directed force which would occur if it struck the tab 184. A generally vertical section 186 of the sleeve 174 extends downwardly from one of the distal ends 180 of the upper generally U-shaped section 176 to a distal end 188 of a lower generally U-shaped section 190 having a central bail portion with generally parallel distal ends 188,194. The vertical section 186 may have one or more vertically oriented reinforcing ribs (not shown) to strengthen the vertical section 186 and prevent twisting of the lower U-shaped member 190 relative to the upper U-shaped member 176. The upper and lower U-shaped sections 176,190 are generally opposed to each other as is shown in FIGS. 15–17 for encircling the vertical tubular member 24 is shown in FIG. 18.

The horizontal arm 172 or other suitable merchandise supporting means extends outwardly from the central bail portion 192 of the lower U-shaped section 190. Preferably the horizontal arm 172 is disposed at 180° to the tab 184 so that the weight of the arm 172 urges the tab into the hole 76. The horizontal arm 172 may be welded to the sleeve 174 as is shown at welds 198 in FIG. 16 or, if arm 172 is a tubular member as is shown, the weld may be made along the inner edge of the arm 172, or may be otherwise suitably attached. If welded, the display member 170 should then be coated to cover discoloration of the horizontal arm 172. The horizontal arm may have an end cap 200 for appearance purposes.

The sleeve 174, and preferably the lower U-shaped section 190, preferably has at least one resilient button 196 of teflon, nylon or other suitable resilient but hard material for engaging the surface of the vertical tubular member 24 when the tab 184 is in a vertically spaced hole 76. The button 196 is designed to prevent the sleeve 174 from scratching the vertical tubular member 24. The button 196 shown is preferably disposed between about 60° and 150° of the horizontal arm 172, and most preferably oriented between about 90° to about 120°, from the horizontal arm 172 so that the resilient button will friction fit with the vertical tubular member 24 when the sleeve 174 is attached to the vertical tubular member 24 and thereby lock the sleeve 174 into place. Where the button 196 is oriented at about 90° to 120°, the sleeve 174 is positively locked in place when the button 196 begins to resiliently return to its original condition. Where it is desired to completely protect the vertical tubular member 24 from scratching, at least one button is mounted on each bail portion and each distal end of each U-shaped section of the sleeve. Alternatively, the inner surfaces of the sleeve 174 may) be coated (not shown) with teflon, or other suitable liner to prevent scratching. Also, other inwardly directed members (not shown) may be used in place of the button 196, including a spring biased catch or a threadably engaged screw disposed in distal end 180 or 182 of the upper U-shaped member 176 or in distal end 188 or 194 of the lower U-shaped member 190. These alternative inwardly directed members are preferably disposed between about 90° and 180° of the horizontal arm 172 for locking the sleeve with the vertical tubular member 24. Preferably the alternative inwardly directed members are nylon or other suitable non-scratching material.

The free distal ends 182, 194 of the upper and lower U-shaped members 176,190 are spaced by a distance 202 at least equal to the diameter 204 of the vertical tubular member 24 for releaseably attaching and removing the display member 170. Thus the merchandise supporting horizontal arm 172 is held vertically upward and the sleeve 174 is slid horizontally over the peripheral surface of the vertical tubular member 24. The horizontal arm 172 is then rotated downwardly and twisted about a vertical axis until the tab 184 is received in the appropriate vertically spaced hole 76 and the button(s) 196 on the lower U-shaped section 190 rests upon the vertical tubular member 24. Where the releasable display member 170 is employed with a fixture having spaced vertical tubular members such a fixture 62 shown in FIG. 3, the axial dimensions 206 208 of the upper and lower U-shaped members 176, 190 respectively is preferrably less that the spacing between the vertical tubular members 64. Thus the peripheral surface of the other vertical tubular members 64 are not inadvertently scratched during the assembly or disassembly of the fixture 62. Preferably the horizontal arm 172 and the horizontal arm 56 of the elongated member are disposed in the same plane so the merchandise may be presented in the same sight.

While certain presently preferred embodiments of the invention have been shown and described, it is to be distinctly understood that the invention is not limited thereto but may be otherwise variously embodied within the scope of the following claims:

What is claimed is:

1. A fixture for displaying merchandise, comprising:

a vertical tubular member having an upper end:

an elongated member having a generally horizontal arm adapted for supporting merchandise and a vertical arm, the vertical arm having a peripheral surface and a distal end, the vertical distal end telescopingly received in the upper end of the vertical tubular member and having a circumferentially spaced protuberances about the peripheral surface near the distal end for maintaining a spaced relationship between the portion of the peripheral surface near the distal end of the vertical arm and the vertical tubular member;

a spacer means mounted on the upper end of the vertical tubular member, the spacer means having circumferentially spaced inwardly-directed downwardly-bent fingers with the spaces between the fingers matching the spacing between the protuberances on the vertical arm, for vertical telescoping movement of the protuberances past the spacer means and for maintaining a spaced relationship between the portion of the peripheral surface of the telescoping vertical arm near the upper end of the vertical tubular member and the vertical tubular member; and a locking means interlocking the telescoping vertical arm and the vertical tubular member.

2. The fixture of claim 1 wherein the vertical tubular member has vertically spaced holes and the interlocking means comprises a bullet catch biased outwardly of the telescoping arm by a spring fixed to the bullet catch for releasably engaging the holes in the vertical tubular member.

3. The fixture of claim 1, wherein the telescoping vertical arm has vertically spaced holes, the spacer means has a side wall with a resilient section extending between two fingers and the interlocking mans comprises an inwardly directed bullet catch attached to the resilient section of the spacer means between two fingers for releasably engaging the holes in the vertical arm in the space between two adjacent fingers.

4. The fixture of claim 3 wherein the bullet catch is disposed at about 180° from a finger spacing the telescoping vertical arm from the vertical tubular member.

5. The fixture of claim 1, wherein the vertical tubular member has a hole, the telescoping vertical arm has vertically spaced hole, the spacer means has a side wall with a resilient section axially spaced from the fingers and the interlocking means comprises an inwardly directed bullet catch attached to the resilient section of the spacer means and extending through the hole in the vertical tubular member for releasably engaging the holes in the telescoping vertical arm below the fingers and the bullet catch is axially aligned with a space between two fingers.

6. The display fixture of claim 1 wherein the vertical tubular member or the vertical arm of the elongated member has vertically spaced holes for receiving a bullet catch for interlocking the vertical tubular member and the telescoping vertical arm, and wherein the fixture further comprises a removable display support member comprising:

a sleeve juxtaposed with the vertical member having:

an upper generally U-shaped section defined by a central bail portion extending to generally parallel distal first and second ends, the central bail portion having an inwardly extending tab adapted to engage one of the vertically spaced holes;

a lower generally U-shaped section defined by a central bail portion extending to generally parallel distal first and second ends, the central portions of the lower and upper U-shaped members disposed on opposite sides of the vertical member;

a generally vertical section extending from a distal first end of the upper U-shaped section to a distal first end of the generally lower U-shaped section, the second ends of the U-shaped member being vertically spaced a distance greater than the cross sectional dimension of the vertical tubular member; and a means for supporting merchandise extending outwardly from the central bail portion of the lower U-shaped section.

7. A display fixture, comprising:

a plurality of attached vertical tubular members;

at least one elongate member having a generally horizontal arm and a vertical arm, the vertical arm having a distal end with a peripheral surface and radially spaced protuberances near the distal end extending beyond the surface, the distal end telescopingly received in the vertical tubular member;

spacer means mounted on the upper end of at least one of the plurality of vertical tubular members, the spacer means having circumferentially spaced inwardly-extending downwardly-bent resilient fingers with the spaced matching the spacing of the protuberances, for telescoping vertical movement of the protuberances past the spacer means and for maintaining the peripheral surface of the vertical arm near the upper end of the vertical tubular member in spaced relationship with the vertical tubular member; and a means for interlocking the vertical arm and the vertical tubular member.

8. A fixture for displaying merchandise, comprising:

a vertical tubular member having an upper end;

an elongated member having a generally horizontal arm adapted for supporting merchandise and a vertical arm, the vertical arm having a peripheral surface and a distal end, the vertical distal end telescopingly received in the upper end of the vertical tubular member and having a circumferentially spaced protuberances about the peripheral surface near the distal end for maintaining a spaced relationship between the portion of the peripheral surface near the distal end of the vertical arm and the vertical tubular member;

a spacer means mounted on the upper end of the vertical tubular member, the spacer means having circumferentially spaced inwardly-downwardly-bent fingers with the spaces between the fingers matching the spacing between the protuberances on the vertical arm, for vertical telescoping movement of the protuberances past the spacer means and for maintaining a spaced relationship between the portion of the peripheral surface of the telescoping vertical arm near the upper end of the vertical tubular member and the vertical tubular member; and a locking means interlocking the telescoping vertical arm and the vertical tubular member.

9. The fixture of claim 8, wherein the spaced inwardly-directed downwardly-bent fingers have distal ends which extend obliquely inwardly.

10. A fixture for displaying merchandise comprising:

a vertically extending tubular member having vertically spaced holes;

an elongated member having a generally horizontal arm for supporting merchandise and having a vertical arm, the vertical arm telescopingly received by the vertically extending tubular member;

a bullet catch adapted to engaged the vertically spaced holes of the vertically extending tubular member for interlocking the vertically extending tubular member and the telescoping vertical arm;

a display support means having a sleeve with an upper section and a lower section, the upper section having an inwardly directed tab adapted to engage a vertically spaced hole in the vertically extending tubular member, and having a display arm generally horizontally extending from the lower section, the display arm disposed at about 180° to the tab and a resilient button extending inwardly of the sleeve and adapted to engage the vertical tubular member when the tab is received in the hole.

11. The display fixture of claim 10, wherein the sleeve has at least one inwardly directed member oriented between about 90° and 120° from the horizontally extending display arm adapted to engage the vertically extending tubular member when the tab is received in a vertically spaced hole.

12. A fixture for displaying merchandise, comprising:

a vertical tubular member having an upper and;

an elongated member having a generally horizontal arm adapted for supporting merchandise and a vertical arm, the vertical arm having a peripheral surface and a distal end, the vertical distal end telescopingly received in the upper end of the vertical tubular member and having a circumferentially spaced protuberances about the peripheral surface near the distal end for maintaining a spaced relationship between the portion of the peripheral surface near the distal end of the vertical arm and the vertical tubular member;

a spacer means mounted on the upper end of the vertical tubular member, the spacer means having circumferentially spaced inwardly directed fingers with the spaces between the fingers matching the spacing between the protuberances on the vertical arm, for vertical telescoping movement of the protuberances past the spacer means and for maintaining a spaced relationship between the portion of the peripheral surface of the telescoping vertical tubular member and the vertical tubular member; and a bullet catch interlocking the telescoping vertical arm and the vertical tubular member;

wherein the vertical tubular member or the vertical arm of the elongated member has vertically spaced holes for receiving a bullet catch for interlocking the vertical tubular member and the telescoping vertical arm, and wherein the fixture further comprises a removable display support member comprising:

a sleeve juxtaposed with the vertical member having:

an upper generally U-shaped section defined by a central bail portion extending to generally parallel distal first and second ends, the central bail portion having an inwardly extending tab adapted to engage one of the vertically spaced holes;

a lower generally U-shaped section defined by a central bail portion extending to generally parallel distal first and second ends, the central portions of the lower and upper U-shaped members disposed on opposite sides of the vertical member:

a generally vertical section extending from a distal first end of the upper U-shaped section to a distal first end of the generally lower U-shaped section, the second ends of the U-shaped member being vertically spaced a distance greater than the cross sectional dimension of the vertical tubular member;

a means for supporting merchandise extending outwardly from the central bail portion of the lower U-shaped section; and at least one resilient button extending inwardly of the sleeve for engaging the vertical tubular member when the tab is received in the hole.

13. The display fixture of claim 12 wherein the tab and the means for supporting merchandise are oriented at about 180° relative to each other.

14. The display fixture of claim 12 wherein the at least one resilient button is disposed on the lower U-shaped section and is oriented between about 60° and 150° of the means for supporting merchandise.

15. The display fixture of claim 12 wherein the at least one resilient button is oriented between about 90° and 120° of the means for supporting merchandise.

16. The display fixture of claim 12, wherein the merchandise supporting means extending from the sleeve of the removable display support member extends in a plane defined by a generally vertical line extending through the vertically spaced holes for receiving the bullet catch and the tab of the sleeve and the horizontal arm of the telescoping elongated member.

17. A display support adapted to be releasably superposed upon a merchandise display fixture for supporting merchandise, comprising:

a sleeve having an upper U-shaped section spaced from a lower U-shaped section, the sections having bail portions adapted to fit over a generally vertical member of a merchandise display fixture;

the upper bail portion having an inwardly downwardly directed tab adapted to engage the merchandise display fixture;

the lower bail portion having a display arm disposed at about 180° to the tab for supporting merchandise; and a resilient button extending inwardly of the sleeve and adapted to engage the vertical tubular member when the tab is received in the hole.

18. The display support of claim 17, wherein said resilient button is oriented between about 60° and 150° of the display arm.

19. A display support adapted to be releasably superposed upon a merchandise display fixture for supporting merchandise, comprising:

a sleeve having an upper U-shaped section spaced from a lower U-shaped section, the sections having bail portions adapted to fit over a generally vertical member of a merchandise display fixture; the sleeve further having at least one inwardly directed resilient button oriented between about 90° and 120° of the arm for releasably engaging the generally vertical member of the merchandise display fixture when the tab engages the fixture;

the upper bail portion having an inwardly directed tab adapted to engage the merchandise display fixture; and the lower bail portion having a display arm disposed at about 180° to the tab for supporting merchandise.

* * * * *